United States Patent [19]

Becker

[11] Patent Number: 4,941,954

[45] Date of Patent: Jul. 17, 1990

[54] ELECTROCHEMICAL PREPARATION OF BRANCHED UNSATURATED DINITRILES

[75] Inventor: James Y. Becker, Omer, Israel

[73] Assignee: E. I. Du Pont de Nemours and Company, Wilmington, Del.

[21] Appl. No.: 349,243

[22] Filed: May 8, 1989

[51] Int. Cl.[5] ..... C25B 3/00

[52] U.S. Cl. ..... 204/59 R

[58] Field of Search ..... 204/73 R, 73 A, 59 R

[56] References Cited

U.S. PATENT DOCUMENTS 3,193,480 7/1965 Batzer et al. ..... 204/72
3,361,653 1/1968 Miller ..... 204/59 R
3,408,367 10/1968 Andreades ..... 204/59 R
3,488,267 1/1970 Sloan ..... 204/74
3,556,961 1/1971 Bizot et al. ..... 204/73 A

*Primary Examiner*—John F. Niebling
*Assistant Examiner*—Steven P. Marquis

[57] ABSTRACT

The preparation of branched unsaturated dinitriles as the major products (along the branched saturated dinitriles as the by-products) is achieved by electrolytic coupling of unsaturated mono nitriles in acetonitrile. All dinitrile products have an odd number of carbons between the two nitrile groups. The starting aliphatic unsaturated nitriles include 2-pentenenitrile, 3-pentenenitrile, 2-butenenitrile and 3-methyl-2-butenenitrile.

9 Claims, No Drawings

ELECTROCHEMICAL PREPARATION OF BRANCHED UNSATURATED DINITRILES

BRIEF DESCRIPTION

This invention relates to the preparation of branched unsaturated dinitriles having an odd number of carbon atoms between the cyano-groups having the formula

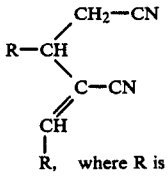

where R is $C_2H_5$ or $CH_3$ by the electrolytic coupling of aliphatic unsaturated nitriles having 4 or 5 carbon atoms. The product of this process may be hydrogenated by known methods to produce unsaturated branched diamines that are useful in the preparation of barrier resins.

As a by-product of the process a dinitrile of the formula: $NCCH_2CH(R)CH(R')CN$ is produced, where R is $C_2H_5$ and R' is hydrogen, and when R is $CH_3$, then R' is either hydrogen or $CH_3$.

BACKGROUND OF THE INVENTION

The electrolytic coupling of nitriles to produce dinitriles is known. See for example Sloan U.S. Pat. Nos. 3,488,267, and also 3,193,480 to Baizer.

The chemical formation of unsaturated dinitriles using precious metal catalysts is disclosed in U.S. Pat. Nos. 4,211,725 and 4,211,725 to Kluger et al.

SUMMARY OF THE INVENTION

The present invention is a process for the non-symmetric dimerization of an aliphatic unsaturated nitrile having 4 or 5 carbon atoms by passing a direct electric current between electrodes located in a non-aqueous reaction mixture containing the aliphatic unsaturated nitrile, and recovering an aliphatic unsaturated dinitrile in which there is an odd number of carbon atoms between the cyano-groups.

Among the suitable starting aliphatic unsaturated nitriles are 2-pentenenitrile, 3-pentenenitrile, 2-butenenitrile, and 3-methyl-2-butenenitrile.

The reaction mixture must contain a conductive compound (electrolyte).

DETAILED DESCRIPTION

In a preferred embodiment the reaction mixture is a non-aqueous mixture of the aliphatic unsaturated nitrile having 4 or 5 carbon atoms, acetonitrile and an electron conducting compound (electrolyte) selected from the class consisting of tetrabutylammonium fluoroborate, $LiClO_4$, $CF_3COONa$, $Ph_4BNa$, and $[(CH_3)_2N]_3SBF_4$. The concentration of the electron conducting compound in the acetonitrile should be at least about 0.1 molar. The concentration of the aliphatic unsaturated nitrile having 4 or 5 carbon atoms in the reaction mixture can vary widely, but is usually present in the amount of about 1 to 10% by volume based on the total volume of the liquids in the reaction mixture.

The desired reaction occurs at the cathode, and if desired an electrolytic cell having separated cathode and anode compartments may be employed. In the case of a separated cell the electrolyte in the anode compartment need not contain any of the aliphatic unsaturated nitrile. A suitable means for separation of the compartments is a glass frit diaphragm.

The electrodes in the electrolytic cell may both be graphite, or the electrode that is connected as cathode may be platinum.

The voltage in the cell should be in the range of 10 to 100 volts, and the amperage should be in the range of about 15 to about 70 milliamps.

The reaction may be initiated at room temperature and at atmospheric pressure.

The reaction is apparently initiated electrolytically, but is continued spontaneously, because the current efficiency is greater than 100%.

The following example illustrates the invention.

EXAMPLE

Both compartments of a two-compartmented cell in which the compartments were separated by a medium glass frit diaphragm were filled with about 150 ml of the following mixture 270 ml of acetonitrile, 30 ml 3-pentene nitrile, 9.5 gr tetrabutylammonium fluoroborate. Both electrodes were graphite rods (⅜ inch in diameter) and were immersed 3 inches in the solution. The two electrodes were connected to 30 volt direct current power supply. Initially the observed current was 28 milliamps. The current then increased to a maximum of 44 milliamps after one hour and dropped to 36 milliamps, when the current was turned off after 145 minutes. 330 coulombs passed through the reaction mixture. The catholyte solution was concentrated by vacuum distillation to remove most of the solvent, acetonitrile. Then a 50 ml of 10% solution of sodium bicarbonate was added to basicify acidic species and to allow a better two-phase separation. The solution was then extracted twice with diethylether. The etheral phase was washed twice with water and dried over magnesium sulfate, then filtered and concentrated by evaporation. The oily residue (10.8 grams) was distilled to afford 2.1 grams of product mixture which contained 3 main components, cis and trans-1,3-dicyano-2-ethyl-3-hexene, and 1,3-dicyano-2-ethyl propane, in the percentages shown below. The current efficiency in this reaction is greater than 800%.

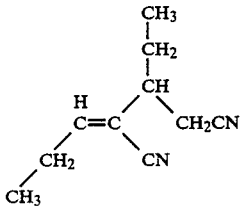

86%

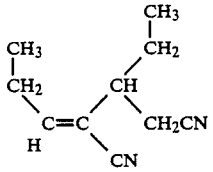

12%

-continued

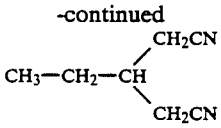

2%

Similar results were obtained when a 1% solution of 2-pentene nitrile (3 ml in 297 ml of acetonitrile) was used and the electricity consumed was 33 coulombs.

I claim:

1. A process for the non-symmetric dimerization of an aliphatic unsaturated nitrile having 4 or 5 carbon atoms which comprises passing a direct electric current between electrodes located in a non-aqueous reaction mixture containing the aliphatic unsaturated nitrile and an electrolyte, and recovering a branched aliphatic unsaturated dinitrile in which there is an odd number of carbon atoms between the cyano-groups and having the formula:

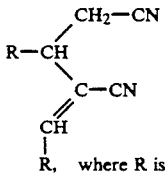

where R is $C_2H_5$ or $CH_3$

2. The process of claim 1 in which the aliphatic unsaturated nitrile is selected from the class consisting of 2-pentenenitrile, 3-pentenenitrile, 2-butenenitrile, and 3-methyl-2-butenenitrile.

3. The process of claim 2 in which the non-aqueous reaction mixture contains acetonitrile, and an electrolyte selected from the class consisting of tetrabutylammonium fluoroborate, $LiClO_4$, $CF_3COONa$, $Ph_4BNa$, and $[(CH_3)_2N]_3SBF_4$.

4. The process of claim 3 in which the reaction mixture is in a two compartment cell and the compartments are separated by a glass frit diaphragm, and in which an electrode is located in each compartment.

5. The process of claim 4 in which the electrodes are graphite.

6. The process of claim 1 in which one electrode is platinum and the platinum electrode is the cathode in the cell.

7. The process of claim 1 in which the aliphatic unsaturated nitrile is 2- or 3-pentenenitrile, and the dinitrile produced is a mixture of cis and trans isomers of 1,3-dicyano-2-ethyl-3-hexene.

8. The of claim 1 in which the reaction mixture consists essentially of the aliphatic unsaturated nitrile, acetonitrile and tetrabutylammonium fluoroborate.

9. The process of claim 1 in which the aliphatic unsaturated nitrile is 2- or 3-pentene nitrile, and an aliphatic saturated dinitrile having the formula $CH_3CH_2CH(CH_2CN)_2$ is also produced by the electrolytic reaction of 2- or 3-pentene nitrile and acetonitrile.

* * * * *